US011487309B2

(12) United States Patent
Huang

(10) Patent No.: US 11,487,309 B2
(45) Date of Patent: Nov. 1, 2022

(54) REFERENCE VOLTAGE GENERATION SYSTEM AND METHOD

(71) Applicants: HKC CORPORATION LIMITED, Shenzhen (CN); CHONGQING HKC OPTOELECTRONICS TECHNOLOGY CO., LTD., Chongqing (CN)

(72) Inventor: Xiaoyu Huang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 713 days.

(21) Appl. No.: 16/314,861

(22) PCT Filed: Oct. 31, 2018

(86) PCT No.: PCT/CN2018/112849

§ 371 (c)(1),
(2) Date: Jan. 3, 2019

(87) PCT Pub. No.: WO2020/019556

PCT Pub. Date: Jan. 30, 2020

(65) Prior Publication Data

US 2021/0325923 A1 Oct. 21, 2021

(30) Foreign Application Priority Data

Jul. 24, 2018 (CN) ..... 201810815500.9

(51) Int. Cl.
*G09G 3/36* (2006.01)
*G05F 1/10* (2006.01)

(52) U.S. Cl.
CPC ..... *G05F 1/10* (2013.01); *G09G 3/3696* (2013.01)

(58) Field of Classification Search
CPC . G05F 1/10; G05F 1/461; G05F 1/462; G05F 1/468; G05F 1/56; G05F 1/59;
(Continued)

(56) References Cited

U.S. PATENT DOCUMENTS 5,489,910 A * 2/1996 Kuwata ..... G09G 3/3611 345/212
6,320,566 B1 * 11/2001 Go ..... G09G 3/3614 345/99

(Continued)

FOREIGN PATENT DOCUMENTS

CN 1183571 A 6/1998
CN 1399241 A 2/2003

(Continued)

OTHER PUBLICATIONS

Wenhua Zhao, the International Searching Authority written comments, dated Apr. 2019, CN.

*Primary Examiner* — Fred E Finch, III

(57) ABSTRACT

The present application discloses a reference voltage generation system and method. The reference voltage generation system includes: a reference voltage generator; and a voltage division circuit coupled to the reference voltage generator. The reference voltage generator is coupled to a reference voltage through the voltage division circuit.

19 Claims, 2 Drawing Sheets

(58) Field of Classification Search
CPC ..... G05F 1/648–656; G09G 3/3655; G09G 3/3696; G09G 2320/0257
See application file for complete search history.

(56) References Cited

U.S. PATENT DOCUMENTS

| | | | | |
|---|---|---|---|---|
| 6,509,895 | B2 * | 1/2003 | Yanagi | H04N 3/127 345/211 |
| 6,888,526 | B2 * | 5/2005 | Morita | G09G 3/2011 345/95 |
| 8,077,127 | B2 * | 12/2011 | Cho | G02F 1/1395 345/87 |
| 9,343,010 | B2 * | 5/2016 | Yang | G09G 3/3216 |
| 2002/0008686 | A1 * | 1/2002 | Kumada | G09G 3/3696 345/94 |
| 2003/0117353 | A1 * | 6/2003 | Moon | G09G 3/3655 345/87 |
| 2003/0151578 | A1 * | 8/2003 | Morita | G09G 3/3688 345/89 |
| 2003/0222837 | A1 * | 12/2003 | Cho | G09G 3/3688 345/87 |
| 2005/0206602 | A1 * | 9/2005 | Kojima | G09G 3/3696 345/96 |
| 2006/0007095 | A1 * | 1/2006 | Kudo | G09G 3/3655 345/98 |
| 2007/0090815 | A1 | 4/2007 | Hsieh | |
| 2007/0152943 | A1 * | 7/2007 | Hwang | G09G 3/3655 345/98 |
| 2008/0284802 | A1 * | 11/2008 | Hirama | G09G 3/3688 345/690 |
| 2009/0027367 | A1 * | 1/2009 | Liu | G09G 3/3655 345/204 |
| 2009/0096976 | A1 * | 4/2009 | Kim | G02F 1/1393 349/143 |
| 2009/0115499 | A1 * | 5/2009 | Chiu | H03K 19/00346 327/538 |
| 2009/0231025 | A1 * | 9/2009 | Wang | G05F 1/56 327/543 |
| 2010/0033413 | A1 * | 2/2010 | Song | G09G 3/3655 345/89 |
| 2010/0245325 | A1 * | 9/2010 | Xiao | G09G 3/3688 345/211 |
| 2016/0266590 | A1 * | 9/2016 | Ura | G09G 3/3696 |
| 2017/0287405 | A1 * | 10/2017 | Tseng | G09G 3/3275 |
| 2017/0337892 | A1 * | 11/2017 | Kim | G02F 1/134336 |
| 2019/0278314 | A1 * | 9/2019 | Hashiguchi | G09G 3/3216 |
| 2019/0354125 | A1 * | 11/2019 | Hubbard | G09G 3/3688 345/690 |
| 2021/0026384 | A1 * | 1/2021 | Jin | G09G 3/2011 345/95 |
| 2021/0225319 | A1 * | 7/2021 | Han | G02F 1/1393 349/143 |

FOREIGN PATENT DOCUMENTS

| | | | | |
|---|---|---|---|---|
| CN | 102034439 | A * | 4/2011 | G09G 3/3614 |
| CN | 102610205 | A * | 7/2012 | G09G 3/3655 |
| CN | 102855862 | A | 1/2013 | |
| CN | 103941491 | A * | 7/2014 | |
| CN | 103941491 | A | 7/2014 | |
| CN | 105976773 | A | 9/2016 | |
| CN | 106297711 | A * | 1/2017 | |

* cited by examiner

REFERENCE VOLTAGE GENERATION SYSTEM AND METHOD

The present application claims priority to the Chinese Patent Application No. CN201810815500.9, filed to the Chinese Patent Office on Jul. 24, 2018, and entitled "REFERENCE VOLTAGE GENERATION SYSTEM AND METHOD", which is incorporated herein by reference in its entirety.

TECHNICAL FIELD

This disclosure relates to a reference voltage generation system and a generation method thereof.

BACKGROUND

The statements herein merely provide background information related to the present application and do not necessarily constitute the prior art.

With the development and advancement of technologies, a liquid crystal display has become a mainstream product of display due to its thin body, power-saving, low radiation and the like, and thus has become an important display platform for IT and video products.

From the perspective of the driving principle of the liquid crystal display, a system mainboard passes a red/green/blue compression signal and a control signal as well as a power supply through a wire, and finally connects to a display region of a display panel, so that the display panel obtains the required power and signal.

The display of the liquid crystal display is driven by voltage, and an array substrate and a color film substrate both ensure the smooth progress of the display process through a reference voltage, and the reference voltages of the array substrate and the color film substrate are often common, although in most of the time, the voltage commonality is not a problem, but the study found that the common use of the reference voltages may cause problems such as image sticking.

SUMMARY

The present application provides a reference voltage generation system and method for generating two servo reference voltages to improve panel quality.

To achieve the foregoing objective, the present application provides a reference voltage generation system, including:

a reference voltage generator, configured to generate a reference voltage;

a voltage division circuit, coupled to the reference voltage generator and configured to divide the reference voltage;

a first substrate, including a first reference voltage; and a second substrate, including a second reference voltage;

the reference voltage generator is coupled to the first reference voltage and/or the second reference voltage through the voltage division circuit.

Optionally, the second reference voltage is coupled to the reference voltage generator.

The reference voltage generation system further includes:

a first switch transistor, a source electrode of which is coupled to the reference voltage generator, a drain electrode is coupled to the second reference voltage of the second substrate, and a gate electrode is coupled to a control signal; and a second switch transistor, a source electrode of which is coupled to an output end of the voltage division circuit, a drain electrode is coupled to the second reference voltage of the second substrate, and a gate electrode is coupled to the gate electrode of the first switch transistor.

Optionally, the voltage division circuit includes:

a second voltage divider, one end of which is grounded, and a first voltage divider, one end of which is coupled to the reference voltage generator, and the other end is grounded through the second voltage divider;

the second reference voltage is coupled between the first voltage divider and the second voltage divider.

Optionally, the reference voltage generation system further includes:

an operational amplifier, one end of which is connected between the first voltage divider and the second voltage divider, and the other end is connected to the second reference voltage.

Optionally, a resistance value of the first voltage divider or the second voltage divider is adjustable.

Optionally, the reference voltage generation system further includes:

a central control panel including a timing controller, the timing controller being configured to output the control signal; and a circuit board, on which the reference voltage generator and the voltage division circuit are disposed.

The present application further discloses a reference voltage generation method, including the following steps:

generating a reference voltage by a reference voltage generator of a circuit board; and conveying the reference voltage to a second reference voltage of the second substrate through a voltage division circuit, and meanwhile, conveying the reference voltage to a first reference voltage of the first substrate.

Optionally, the step of conveying the reference voltage to a second reference voltage of the second substrate through a voltage division circuit, and meanwhile, conveying the reference voltage to a first reference voltage of the first substrate includes:

dividing the reference voltage by the voltage division circuit to obtain a divided voltage; and conveying the divided voltage to the second reference voltage after being processed by an operational amplifier.

Optionally, the step of conveying the reference voltage to a second reference voltage of the second substrate through a voltage division circuit, and meanwhile, conveying the reference voltage to a first reference voltage of the first substrate further includes:

coupling an output end of the operational amplifier to the second reference voltage through a first switch transistor when a control signal is in high level.

Optionally, the step of conveying the reference voltage to a second reference voltage of the second substrate through a voltage division circuit, and meanwhile, conveying the reference voltage to a first reference voltage of the first substrate further includes:

coupling the reference voltage generator to the second reference voltage through a second switch transistor when the control signal is in high level.

According to the reference voltage generation system of the present application, the reference voltage generator can be further improved according to the panel needs, and the reference voltage generator of the exemplary architecture can be used. In addition, the generation system further includes a voltage division circuit, which is configured to divide the reference voltage and then conveys the divided voltage to the first reference voltage or the second reference voltage, so that the first reference voltage and the second reference voltage are independent of each other, thereby preventing the first reference voltage and the second reference voltage from interfering with each other to cause image sticking, and improving the quality and yield of the panel.

BRIEF DESCRIPTION OF DRAWINGS

The drawings are included to provide optional understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
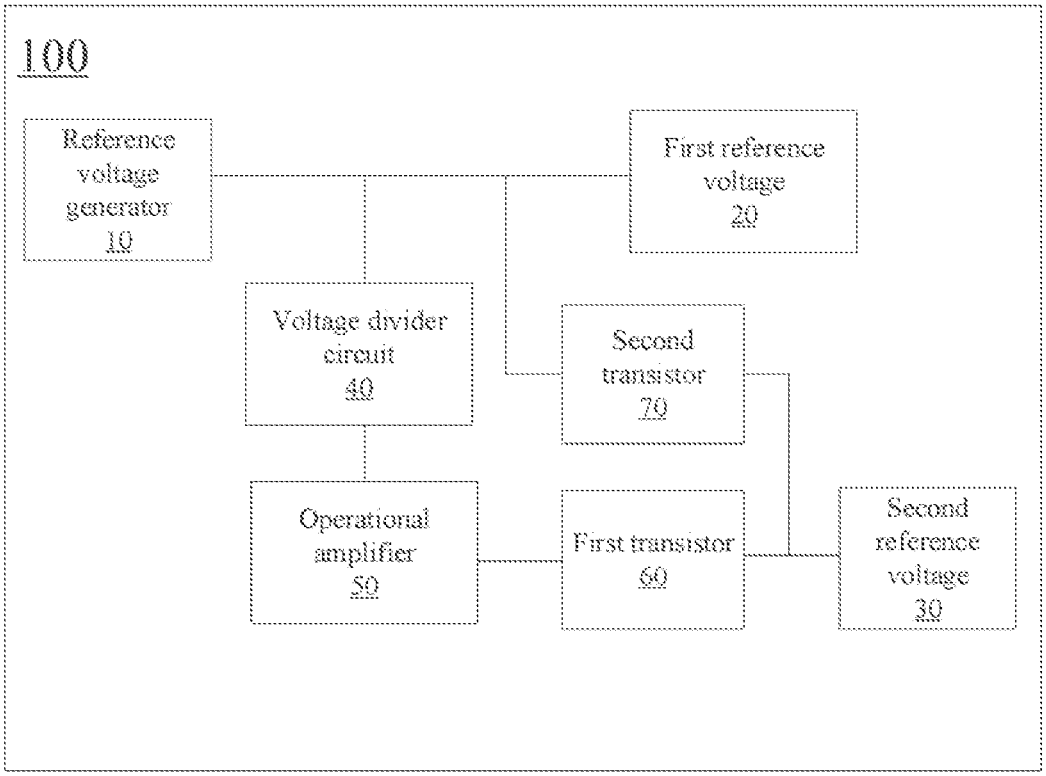
FIG. 1 is a schematic diagram of a reference voltage generation system according to one of the embodiments of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by a person of ordinary skill in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

In the drawings, units of similar structures are represented by the same reference numerals.

Figure 2:
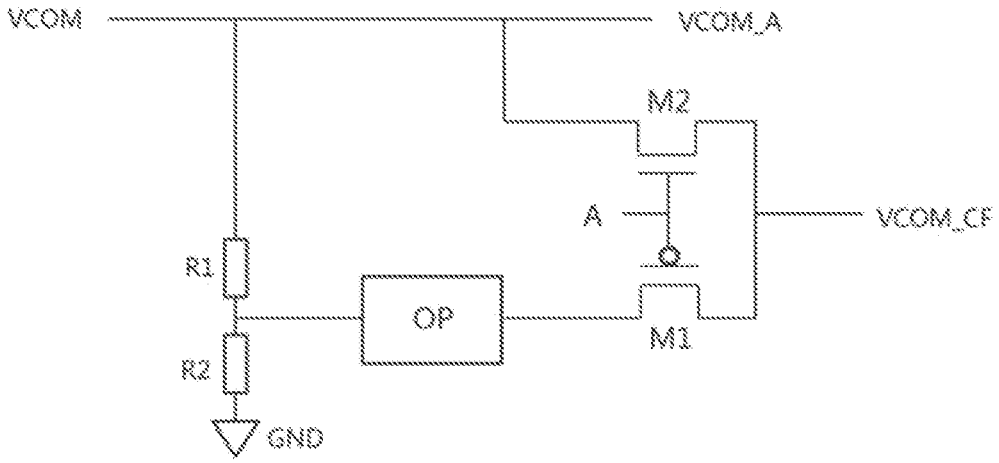
FIG. 2 is a specific circuit diagram of a reference voltage generation system according to one of the embodiments of the present application.

FIG. 1 is a schematic diagram of a reference voltage generation system according to the present application; and FIG. 2 is a specific circuit diagram of a reference voltage generation system according to the present application. Referring to FIGS. 1 and 2.

The present application provides a reference voltage generation system 100, including:

a reference voltage generator 10, configured to generate a reference voltage (corresponding to the reference numeral VCOM in FIG. 2); and a voltage division circuit 40, coupled to the reference voltage generator 10 and configured to divide the reference voltage.

The reference voltage generator 10 is coupled to a first reference voltage 20, namely VCOM A shown in FIG. 2, and/or a second reference voltage 30, namely VCOM_CF shown in FIG. 2, through the voltage division circuit 40.

According to the reference voltage generation system of the present application, the reference voltage generator can be further improved according to the panel needs, and the reference voltage generator of the exemplary architecture can be used. In addition, the generation system further includes a voltage division circuit, which is configured to divide the reference voltage and then conveys the divided voltage to the first reference voltage or the second reference voltage, so that the first reference voltage and the second reference voltage are independent of each other, thereby preventing the first reference voltage and the second reference voltage from interfering with each other to cause image sticking, and improving the quality and yield of the panel.

In an embodiment, the second reference voltage is coupled to the reference voltage generator 10.

The reference voltage generation system 100 further includes:

a first switch transistor 60 (corresponding to the reference numeral M1 in FIG. 2), a source electrode of which is coupled to the reference voltage generator 10, a drain electrode is coupled to the second reference voltage, and a gate electrode is coupled to a control signal A; and a second switch transistor 70 (corresponding to the reference numeral M2 in FIG. 2), a source electrode of which is coupled to an output end of the voltage division circuit 40, a drain electrode is coupled to the second reference voltage, and a gate electrode is coupled to the gate electrode of the first switch transistor 60. In this embodiment, the first switch transistor is optionally a PMOS transistor, and the second switch transistor is optionally an NMOS transistor; the first reference voltage is equal to the reference voltage; the second reference voltage is coupled to the reference voltage generator through the voltage division circuit, the first switch transistor, or the second switch transistor; when the second reference voltage is coupled to the reference voltage generator through the second switch transistor, the second reference voltage is equal to the reference voltage; and when the second reference voltage is coupled to the reference voltage generator through the voltage division circuit and the first switch transistor, the second reference voltage is equal to the divided voltage. In this way, the drive architecture decides whether to respectively set the first reference voltage and the second reference voltage according to whether to improve the image quality problems such as image sticking.

In an embodiment, the voltage division circuit 40 includes:

a second voltage divider R2, one end of which is grounded; and a first voltage divider R1, one end of which is coupled to the reference voltage generator 10, and the other end is grounded through the second voltage divider R2.

The second reference voltage is coupled between the first voltage divider R1 and the second voltage divider R2. In this embodiment, the first voltage divider and the second voltage divider may be resistors or others. Taking a voltage division resistor as an example, a voltage value B of the divided voltage is related to the ratio of the first voltage divider R1 to the second voltage divider R2, specifically, B=VCOM*R2/(R1+R2). In this way, the voltage values of the first voltage divider R1 to the second voltage divider R2 are kept as follows, so that the second reference voltage is adjusted by adjusting the sizes of the first voltage divider and the second voltage divider according to actual conditions to ensure adaptation to a specific display panel.

In an embodiment, the reference voltage generation system 100 further includes:

an operational amplifier 50 (corresponding to the reference numeral OP in FIG. 2), one end of which is connected between the first voltage divider R1 and the second voltage divider R2, and the other end is connected to the second reference voltage. In this embodiment, an operational amplifier is further provided between the second reference voltage and the voltage division circuit. The operational amplifier is a power operational amplifier. Due to the possible wear and tear in the voltage division circuit, it is needed to provide a power operational amplifier to increase a driving circuit of the second reference voltage, to avoid the back-end panel load affecting the voltage value of the second reference voltage, resulting in driving and display problems.

In an embodiment, the first voltage divider R1 includes a first resistor, and the second voltage divider R2 includes a second resistor, where the first voltage divider R1 and the second voltage divider R2 may be a resistor, separately, or may be a set of resistors connected in series-parallel. Moreover, the resistor or the set of resistors may be a fixed resistance value after pre-testing, or may be a variable resistor to suit a wider variety of panels.

In an embodiment, a resistance value of the first voltage divider R1 or the second voltage divider R2 is adjustable. In this embodiment, the first voltage divider or the second voltage divider may be detachable and replaceable, or may be a variable resistor with a variable resistance value. In this way, for different panels, the first reference voltage can be changed by adjusting the voltage of the reference voltage generator, and a second reference voltage in proportional to the first reference voltage is obtained by changing the resistance value of the first voltage divider or the second voltage divider.

In an embodiment, the reference voltage generation system 100 further includes:

a central control panel (not shown) including a timing controller (not shown), the timing controller being configured to output the control signal, and a circuit board (not shown), on which the reference voltage generator and the voltage division circuit are disposed. In this embodiment, the timing controller is configured to output a control signal; and the control signal is configured to control turn-on of the first and second switch transistors; when the control signal A is in low level, the first switch transistor is turned on, and the second switch transistor is turned off, at this time, the first reference voltage is equal to the reference voltage, and the second reference voltage is equal to the divided voltage; when the control signal A is in high level, the first switch transistor is turned off, and the second switch transistor is turned on, at this time, the first reference voltage is equal to the reference voltage, and the second reference voltage is equal to the reference voltage. In this way, the drive architecture decides whether to respectively set the first reference voltage and the second reference voltage according to whether to improve the image quality problems such as image sticking, thereby expanding the scope of application.

The circuit board may include a Printed Circuit Board (PCB), or other similar devices.

Figure 3:
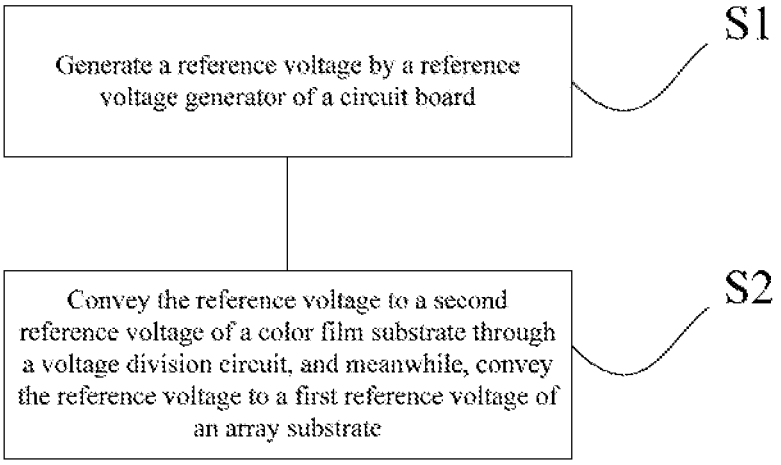
FIG. 3 is an application flowchart of a reference voltage generation method according to one of the embodiments of the present application.

FIG. 3 is an application flowchart of a reference voltage generation method according to the present application. Referring to FIGS. 1, 2, and 3, the present application further discloses a reference voltage generation method, including the following steps:

S1: Generate a reference voltage by a reference voltage generator of a circuit board.

S2: Convey the reference voltage to a second reference voltage through a voltage division circuit, and meanwhile, convey the reference voltage to a first reference voltage.

The reference voltage generation method according to the present application is an application method based on the reference voltage generation system, where the reference voltage generator can be further improved according to the panel needs, and the reference voltage generator of the exemplary architecture can be used. In addition, the generation system further includes a voltage division circuit, which is configured to divide the reference voltage and then conveys the divided voltage to the first reference voltage or the second reference voltage, so that the first reference voltage and the second reference voltage are independent of each other, thereby preventing the first reference voltage and the second reference voltage from interfering with each other to cause image sticking, and improving the quality and yield of the panel.

In an embodiment, the step of conveying the reference voltage to a second reference voltage through a voltage division circuit, and meanwhile, conveying the reference voltage to a first reference voltage includes:

Divide the reference voltage by the voltage division circuit to obtain a divided voltage.

Convey the divided voltage to the second reference voltage after being processed by an operational amplifier. In this embodiment, the divided voltage is conveyed to the second reference voltage after being subjected to driving power amplification in the operation amplifier, to avoid the back-end panel load affecting the voltage value of the voltage divided by a resistor, resulting in driving and display problems.

In an embodiment, the step of conveying the reference voltage to a second reference voltage through a voltage division circuit, and meanwhile, conveying the reference voltage to a first reference voltage further includes:

When the control signal is in high level, an output end of the operation amplifier is coupled to the second reference voltage through the first switch transistor. In this embodiment, the timing controller is configured to output a control signal, and the control signal is configured to control turn-on of the first and second switch transistors: when the control signal A is in high level, the first switch transistor is turned off, and the second switch transistor is turned on, at this time, the first reference voltage is equal to the reference voltage, and the second reference voltage is equal to the reference voltage. In this way, the drive architecture decides whether to respectively set the first reference voltage and the second reference voltage according to whether to improve the image quality problems such as image sticking, thereby expanding the scope of application.

In an embodiment, the step of conveying the reference voltage to a second reference voltage through a voltage division circuit, and meanwhile, conveying the reference voltage to a first reference voltage further includes:

When the control signal is in low level, the reference voltage generator is coupled to the second reference voltage through the second switch transistor. In this embodiment, the timing controller is configured to output a control signal, and the control signal is configured to control turn-on of the first and second switch transistors; when the control signal A is in low level, the first switch transistor is turned on, and the second switch transistor is turned off, at this time, the first reference voltage is equal to the reference voltage, and the second reference voltage is equal to the divided voltage.

The panel of the present application may be a Twisted Nematic (TN) panel, an In-Plane Switching (IPS) panel, and a Multi-domain Vertical Alignment (VA) panel, and of course, can also be other types of panels, if appropriate.

The contents above are further detailed descriptions of the present application in conjunction with specific embodiments, and the specific implementation of the present application is not limited to these descriptions. It will be apparent to a person of ordinary skill in the art that various simple deductions or substitutions may be made without departing from the spirit of the present application, and should be considered to fall into the scope of protection of the present application.

What is claimed is:

1. A reference voltage generation system, comprising:

a reference voltage generator, configured to generate and output a reference voltage; and a voltage division circuit, coupled to an output of the reference voltage generator and configured to divide the reference voltage to obtain a divisional voltage;

the reference voltage generator is coupled to a first reference voltage and/or a second reference voltage through the voltage division circuit; wherein the first reference voltage is coupled to the reference voltage through a first circuit path, and the second reference voltage is coupled to the reference voltage through a second circuit path different from the first circuit path, and wherein the first reference voltage and the second reference voltage are independent of each other;

wherein the first reference voltage is supplied as a common voltage to one of an array substrate or a color film substrate of a display panel, and the second reference voltage is supplied as a common voltage to the other of the array substrate or the color film substrate.

2. The reference voltage generation system according to claim 1, wherein the first reference voltage is directly coupled to the output of the reference voltage generator through a wire;

wherein the reference voltage generation system further comprises:

a first switch transistor, a source electrode of which is directly coupled to the output of the reference voltage generator through a wire, a drain electrode is coupled directly to the second reference voltage, and a gate electrode is coupled directly to a control signal; and a second switch transistor, a source electrode of which is coupled to an output end of the voltage division circuit, a drain electrode is coupled directly to the second reference voltage, and a gate electrode is coupled directly to the gate electrode of the first switch transistor.

3. The reference voltage generation system according to claim 2, wherein the reference voltage generation system further comprises:

a central control panel comprising a timing controller, the timing controller being configured to output the control signal; and a circuit board, on which the reference voltage generator and the voltage division circuit are disposed.

4. The reference voltage generation system according to claim 3, wherein the circuit board is a printed circuit board.

5. The reference voltage generation system according to claim 2, wherein the gate electrode of the first switch transistor and the gate electrode of the second switch transistor are both coupled to the same control signal.

6. The reference voltage generation system according to claim 5, wherein the first reference voltage is equal to the reference voltage in magnitude, wherein when the first switch transistor is turned on by the control signal, the second switch transistor is turned off, and the second reference voltage is equal to the first reference voltage in magnitude, and wherein when the first switch transistor is turned off by the control signal, the second switch transistor is turned on, and the second reference voltage is in proportion to the first reference voltage in magnitude by a factor less than 1.

7. The reference voltage generation system according to claim 2, wherein the first switch transistor is a PMOS transistor, and the second switch transistor is an NMOS transistor.

8. The reference voltage generation system according to claim 2, wherein the second reference voltage is coupled to the output end of voltage division circuit through the first switch transistor and an operational amplifier in sequence.

9. The reference voltage generation system according to claim 1, wherein the voltage division circuit comprises:

a second voltage divider, one end of which is grounded; and a first voltage divider, one end of which is coupled to the reference voltage generator, and the other end is grounded through the second voltage divider;

the second reference voltage is coupled to between the first voltage divider and the second voltage divider.

10. The reference voltage generation system according to claim 9, wherein the first voltage divider comprises a first resistor; and the first resistor and the second voltage divider are connected in series.

11. The reference voltage generation system according to claim 9, wherein the second voltage divider comprises a second resistor; and the second resistor and the first voltage divider are connected in series.

12. The reference voltage generation system according to claim 9, wherein the first voltage divider comprises a first resistor; the second voltage divider comprises a second resistor; and the first resistor and the second resistor are connected in series.

13. The reference voltage generation system according to claim 12, wherein the first resistor and the second resistor are fixed resistors.

14. The reference voltage generation system according to claim 12, wherein the first resistor and the second resistor are detachable and replaceable.

15. The reference voltage generation system according to claim 9, wherein the reference voltage generation system further comprises: an operational amplifier, one end of which is connected between the first voltage divider and the second voltage divider, and the other end is connected to the second reference voltage through the second switch transistor.

16. The reference voltage generation system according to claim 9, wherein a resistance value of the first voltage divider or the second voltage divider is adjustable.

17. A reference voltage generation method, comprising the following steps:

generating a reference voltage by a reference voltage generator of a circuit board; and conveying the reference voltage to a second reference voltage through a voltage division circuit, and meanwhile, conveying the reference voltage to a first reference voltage;

wherein the first reference voltage is coupled to the reference voltage through a first circuit path, and the second reference voltage is coupled to the reference voltage through a second circuit path different from the first circuit path, and wherein the first reference voltage and the second reference voltage are independent of each other;

wherein the first reference voltage is supplied as a common voltage to one of an array substrate or a color film substrate of a display panel, and the second reference voltage is supplied as a common voltage to the other of the array substrate or the color film substrate.

18. The reference voltage generation method according to claim 17, wherein the step of conveying the reference voltage to a second reference voltage through a voltage division circuit, and meanwhile, conveying the reference voltage to a first reference voltage comprises:

dividing the reference voltage by the voltage division circuit to obtain a divided voltage; and conveying the divided voltage to the second reference voltage after being processed by an operational amplifier, wherein the operational amplifier is connected between output end of the voltage division circuit and a first switch transistor.

19. A reference voltage generation system, comprising:

a reference voltage generator, configured to generate and output a reference voltage; and a voltage division circuit, coupled to an output of the reference voltage generator and configured to divide the reference voltage to obtain a divisional voltage;

the reference voltage generator is coupled to a first reference voltage and/or a second reference voltage through the voltage division circuit; wherein the first reference voltage is coupled to the reference voltage through a first circuit path, and the second reference voltage is coupled to the reference voltage through a second circuit path different from the first circuit path, and wherein the first reference voltage and the second reference voltage are independent of each other;

the reference voltage is coupled to the reference voltage generator;

the reference voltage generation system further comprises:

a first switch transistor, a source electrode of which is directly coupled to the output of the reference voltage generator, a drain electrode is coupled directly to the second reference voltage, and a gate electrode is directly coupled to a control signal; and a second switch transistor, a source electrode of which is coupled to an output end of the voltage division circuit, a drain electrode is directly coupled to the second reference voltage, and a gate electrode is coupled directly to the gate electrode of the first switch transistor;

the voltage division circuit comprises:

a second voltage divider, one end of which is grounded; and a first voltage divider, one end of which is coupled to the reference voltage generator, and the other end is grounded through the second voltage divider;

the second reference voltage is coupled to between the first voltage divider and the second voltage divider;

the reference voltage generation system further comprises:

an operational amplifier, one end of which is connected between the first voltage divider and the second voltage divider, and the other end is connected to the second reference voltage through the second switch transistor;

wherein a resistance value of the first voltage divider or the second voltage divider is adjustable;

wherein the first reference voltage is supplied as a common voltage to one of an array substrate or a color film substrate of a display panel, and the second reference voltage is supplied as a common voltage to the other of the array substrate or the color film substrate.

* * * * *